US007647740B2

(12) United States Patent
Engstrom

(10) Patent No.: US 7,647,740 B2
(45) Date of Patent: Jan. 19, 2010

(54) JOINT PROFILE FOR A PANEL

(75) Inventor: Nils-Erik Engstrom, Trelleborg (SE)

(73) Assignee: Pergo (Europe) AB, Trelleborg (SE)

( * ) Notice: Subject to any disclaimer, the term of this patent is extended or adjusted under 35 U.S.C. 154(b) by 115 days.

(21) Appl. No.: 11/229,836

(22) Filed: Sep. 20, 2005

(65) Prior Publication Data

US 2007/0094975 A1 May 3, 2007

(30) Foreign Application Priority Data

Jul. 11, 2005 (SE) ..... 0501638

(51) Int. Cl.
*E04B 2/00* (2006.01)

(52) U.S. Cl. ..... 52/582.1; 52/396.04; 52/578; 52/592.1

(58) Field of Classification Search ..... 52/396.04, 52/396.1, 582.1, 586.2, 288.1, 578, 592.1
See application file for complete search history.

(56) References Cited

U.S. PATENT DOCUMENTS

| | | | | | |
|---|---|---|---|---|---|
| 1,723,306 | A * | 8/1929 | Sipe | 52/396.04 |
| 2,982,380 | A * | 5/1961 | Rose | 52/578 |
| 3,363,383 | A * | 1/1968 | La Barge | 52/471 |
| 4,426,840 | A * | 1/1984 | Yasui et al. | 57/301 |
| 4,435,935 | A * | 3/1984 | Larrea | 52/461 |
| 4,461,131 | A * | 7/1984 | Pressell | 52/395 |
| 4,599,841 | A * | 7/1986 | Haid | 52/396.04 |
| 5,148,850 | A * | 9/1992 | Urbanick | 160/231.1 |
| 5,694,730 | A * | 12/1997 | Del Rincon et al. | 52/586.1 |
| 5,797,237 | A * | 8/1998 | Finkell, Jr. | 52/589.1 |
| 5,894,701 | A * | 4/1999 | Delorme | 52/801.11 |
| 6,006,486 | A * | 12/1999 | Moriau et al. | 52/589.1 |
| 6,065,262 | A * | 5/2000 | Motta | 52/582.1 |
| 6,209,278 | B1 * | 4/2001 | Tychsen | 52/592.4 |
| 6,363,677 | B1 * | 4/2002 | Chen et al. | 52/586.1 |
| 6,438,919 | B1 * | 8/2002 | Knauseder | 52/586.2 |

(Continued)

FOREIGN PATENT DOCUMENTS

| | | |
|---|---|---|
| FR | 2 268 922 | 4/1974 |

(Continued)

*Primary Examiner*—Richard E Chilcot, Jr.
*Assistant Examiner*—Chi Q Nguyen
(74) *Attorney, Agent, or Firm*—Novak Druce & Quigg LLP

(57) ABSTRACT

A joint profile (1) intended to be arranged between panels (2 and 3 respectively). The joint profile (1) comprises a first edge portion (10) and a second edge portion (11). The first edge portion (10) comprises a main body portion (101), a bridge portion (102) being at one end connected to the main body portion (101) said bridge portion (102) further being provided with a distal edge (103) and a connector means (104) arranged close to the distal edge (103). The second edge portion (11) is provided with a second main body portion (111) comprising a connector receiving means (114). The main body portion (101) is provided with an edge portion (105) having a geometry adapted for joining with a selected edge ($2^{I}$, $2^{II}$, $3^{I}$ and $3^{II}$ respectively) of the panels (2 and 3 respectively). The second main body portion (111) is provided with an edge member (115) having a geometry adapted for joining with a selected edge ($2^{I}$, $2^{II}$, $3^{I}$ and $3^{II}$ respectively) of the panels (2 and 3 respectively).

21 Claims, 1 Drawing Sheet

Figure 1:
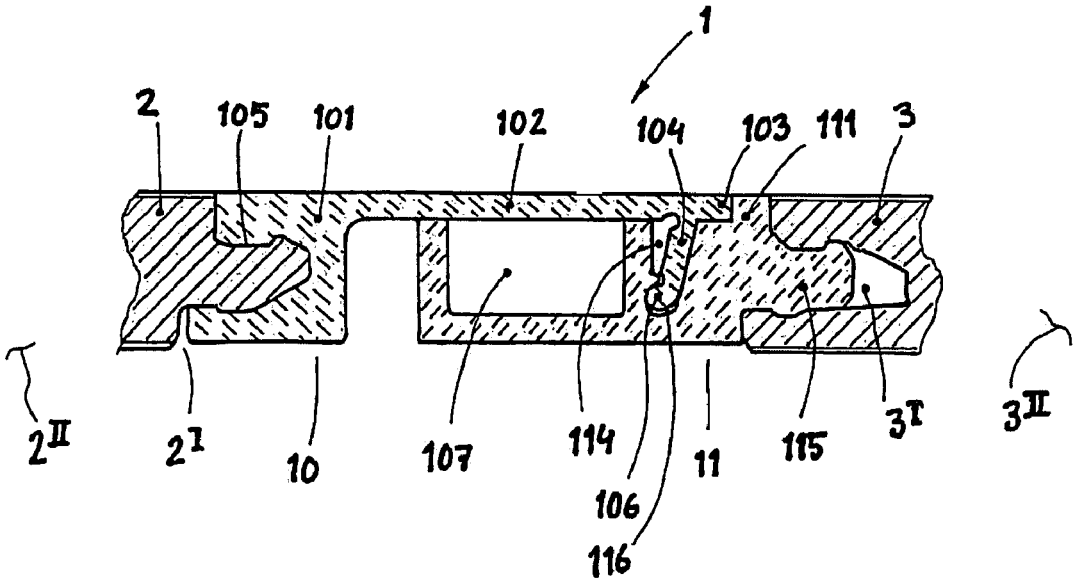

U.S. PATENT DOCUMENTS 6,532,709 B2 * 3/2003 Pervan ..... 52/403.1
6,647,690 B1 * 11/2003 Martensson ..... 52/601
6,763,643 B1 * 7/2004 Martensson ..... 52/586.1
6,769,835 B2 * 8/2004 Stridsman ..... 404/41
6,922,964 B2 * 8/2005 Pervan ..... 52/551
7,010,894 B1 * 3/2006 Cappelle ..... 52/480
2006/0070333 A1 * 4/2006 Pervan ..... 52/592.1
2006/0101769 A1 * 5/2006 Pervan et al. ..... 52/591.1

FOREIGN PATENT DOCUMENTS

WO WO 9966151 A1 * 12/1999
WO WO 0020706 A1 * 4/2000

* cited by examiner

JOINT PROFILE FOR A PANEL

The present invention relates to a joint profile are assembled between and together with panels.

Prefabricated floor boards provided with tongue and groove at the edges are quite common nowadays. These can be installed by the average handy man as they are very easy to install. Such floors can, for example, be constituted of solid wood, fibre board or particle board. These are most often provided with a surface layer such as lacquer, or some kind of laminate. The boards are most often installed by being glued via tongue and groove. The most common types of tongue and groove are however burdened with the disadvantage to form gaps of varying width between the floor boards in cases where the installer hasn't been thorough enough. Dirt will easily collect in such gaps. Moisture will furthermore enter the gaps which will cause the core to expand in cases where it is made of wood, fibre board or particle board, which usually is the case. The expansion will cause the surface layer to rise closest to the edges of the joint which radically reduces the useful life of the floor since the surface layer will be exposed to an exceptional wear. Different types of tensioning devices, forcing the floor boards together during installation can be used to avoid such gaps. This operation is however more or less awkward. It is therefore desirable to achieve a joint which is self-guiding and thereby automatically finds the correct position. Such a joint would also be possible to utilise in floors where no glue is to be used.

The different types of floor panels caught by the description above are all of the type known as floating floor installations. This means that the panels are attached, one to the other but not to the subjacent subfloor. Such a floating floor is allowed to expand and contract with change in moisture content. Such changes in moisture content will demand that there is sufficient space between the circumscribing edge of the floor installation and the surrounding walls. These space are normally covered by mouldings but in larger rooms and long corridors it will be necessary to install so called dilatation profiles to take up the naturally occurring movement in the floating floor. These dilatation devices are normally bulky and aren't always a welcome feature in the interior design. In fact, in some markets they are known as "speed bumps". It is also important to take good care of items like water pipes for radiators coming up through the floor. It has occurred that such pipes have been caused to leak by expanding floating floor installations.

Another known problem is when for example a heavy book shelf is placed in one end of a room and a heavy piano is placed on the opposite end of the room after a warm wet summer. Once the moisture content in the panels decreases in the late autumn, the floor will try to move the piano and book shelf closer to each other. If it does not succeed in this attempt, and it seldom does, undesired cracks will appear in the floor.

The above mentioned problems are solved through the present invention, whereby a joint profile for panels where a predetermined amount of expansion and contraction in the panels is absorbed in the joint is achieved. Accordingly the inventions deals with a joint profile intended to be arranged between panels. The joint profile comprises a first edge portion and a second edge portion. The invention is characterised in that the first edge portion comprises a main body portion, a bridge portion being at one end connected to the main body portion, said bridge portion further being provided with a distal edge and a connector means arranged close to the distal edge. The second edge portion is provided with a second main body portion comprising a connector receiving means. The main body portion is further provided with an edge portion having a geometry adapted for joining with a selected edge of the panels. The second main body portion is further provided with an edge member having a geometry adapted for joining with a selected edge of the panels.

The edge portion is preferably provided with joining means selected from the group consisting of; tongue, groove, undercut, protrusion, girder, web, lower cheek, upper cheek, resilient portion, hook, grapnel, claw and a combination thereof.

The edge member is preferably provided with joining means selected from the group consisting of; tongue, groove, undercut, protrusion, girder, web, lower cheek, upper cheek, resilient portion, hook, grapnel, claw and a combination thereof.

The connector means is suitably provided with a protruding lower end and that the connector receiving means are provided with a cavity intended for receiving the protruding lower end of the connector means. It is hereby suitable to make the connector means flexible. The connector receiving means is suitably so designed as to allow the connector means to flex angularly around a lower pivot point.

According to a preferred embodiment of the invention the connector receiving means is so designed as to allow the connector means to move, thereby allowing the bridge portion to move in a horizontal direction relative the second main body portion. The allowed horizontal movement results in a play which suitably is in the range 0.1-5 mm.

The portion arranged between the distal edge and an upper portion of the selected edge of the panels is suitably made resilient.

According to one embodiment of the invention a hollow space is formed under the bridge portion. This hollow space may then be used for arranging electrical cables, data cables, lighting, air evacuation or the like. The different elements of the joint profile are suitably made of thermoplastic material, thermosetting resin or metal such as aluminium. One suitable way of manufacturing such a profile is by extrusion. The profiles may be uniformly coloured, or even transparent (if made of plastic that is) but is of course possible to provide upper surfaces with any suitable decor. It is however suitable to provide the upper surface of the profile with a coating allowing it to match the wear resistance of the panels it is going to bridge. The edges of the profile designed to mate with edges of panels are suitably designed so that this joint becomes very tight and impenetrable to water and dirt. The remaining part of the joint profile is protected from the effects of water due to the fact that it can be made of materials like plastic or metal.

The invention also deals with a second preferred embodiment of the invention where a joint profile is intended to be arranged between panels. The invention is characterised in that a joint profile comprises a first edge portion, a second edge portion and a bridge portion.

The first edge portion comprises a first main body portion comprising a connector receiving means. The first main body portion is provided with an edge portion having a geometry adapted for joining with a selected edge of the panels.

The bridge portion is at one end connected to the first main body portion via a first connector means adapted to fit the connector receiving means. The bridge portion is further being provided with a second end being provided with a second connector means adapted to fit the connector receiving means.

The second edge portion is provided with a second main body portion comprising a connector receiving means. The second main body portion is provided with an edge member having a geometry adapted for joining with a selected edge of the panels.

The edge portion is suitably provided with joining means selected from the group consisting of; tongue, groove, undercut, protrusion, girder, web, lower cheek, upper cheek, resilient portion, hook, grapnel, claw and a combination thereof.

The edge member is provided with joining means selected from the group consisting of; tongue, groove, undercut, protrusion, girder, web, lower cheek, upper cheek, resilient portion, hook, grapnel, claw and a combination thereof.

The first and second connector means is suitably provided with a protruding lower end and the connector receiving means are provided with a cavity intended for receiving the protruding lower end of the connector means.

The first and second connector means is suitably flexible. The connector receiving means is suitably so designed as to allow the first connector means to flex angularly around a lower pivot point. The connector receiving means is suitably so designed as to allow the also second connector means to flex angularly around a lower pivot point. The connector receiving means are preferably so designed as to allow the first and second connector means to move, thereby allowing the bridge portion to move in a horizontal direction relative the first and or second main body portion.

The allowed horizontal movement results in a play which suitably is in the range 0.1-10 mm.

This play is designed so that the distance between the mating surfaces is very small when the moisture level in the panel is at its highest practical level. The distance will be at its largest when the panel has low or no moisture content.

The herein described joint may be used on every panel and every edge thereof in a floor installation. However it is advantageous to use it only on portions thereof such as only every other, third, fifth or tenth panel and only on long side edges thereof. The joint can also be used as a design feature. It is through the present invention possible to achieve dilatation in a floating floor which is flush with the upper surface of the floor. This is highly desired.

The movement in each joint is of course depending on the maximum and minimum moisture levels in the panel as well as the distance between the joints according to the invention. However, an allowed movement of 1 mm/meter of panel is normally more than enough.

The joint profiles are suitably shaped as extended profiles which may be manufactured through extrusion which is a well known and rational method. The joint profiles are suitably shaped as extended lengths or rolls which can be cut to the desired length. The length of the joint profiles considerably exceeds the length of a floor element, before being cut. An advantage with such long profiles is that they can be laid over the whole width of the floor and will thereby reduce the risk for deviations and gaps in the floor since it bridges the lateral joints of the floor. Such bridging of the lateral joints can of course be used even if the joint profiles have the same length as, or is shorter than the floor elements. Shorter pieces of joint profiles is suitably used when it comes to the lateral joints of the floor.

Suitable materials are thermoplastic materials such as polyolefins, polystyrene, polyvinyl chloride or acrylnitril-butadiene-styrene-copolymer. These can suitably be filled with for example wood powder, lime or fibre such as glass fibre in order to increase the dimension stability. The top, visible surface of the joining profile may be decorated through any known means. It is however suitable to make this surface abrasion resistant enough to match the panels it is to be installed together with. It is also possible to make the joining profile of metal such as aluminium or steel. This profile may then be provided with a bellow-like structure to absorb the movement, have elastic portions of materials like rubber or being designed to bow downwards or upwards. It may be considered advantageous to design the portion arranged between the end of the bridge portion and an upper portion of the selected edge of the panels to be made resilient. This can for example be achieved by making this portion of an elastic material like rubber or the like. The elastic portion is then designed so that it will be in full contact with the end of the bridge portion as well as the edge of the panel when the joint is fully extended. The elastic portion will then be compressed when the distance between the panels decrease.

The invention is described further together with enclosed figures showing different embodiments of the invention whereby, FIG. 1 shows in cross-section a joint profile for panels according to a first embodiment of the present invention.

Figure 2:
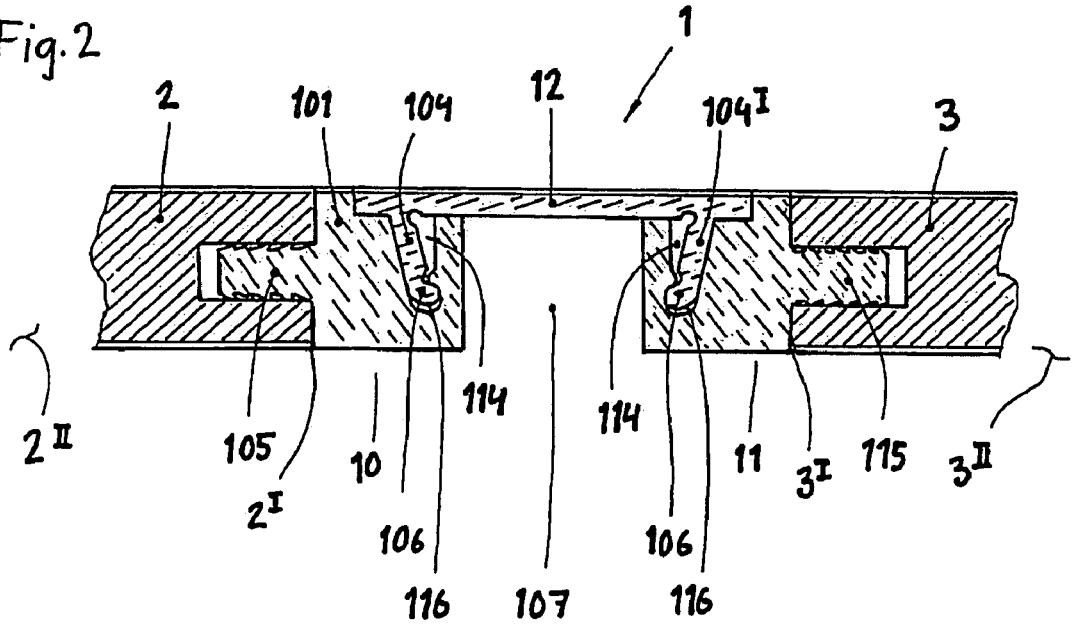

FIG. 2 shows in cross-section a joint profile for panels according to a second embodiment of the present invention.

Accordingly, FIG. 1 shows in cross-section a joint profile for panels according to a first embodiment of the present invention. FIG. 1 shows a joint profile 1 intended to be arranged between panels 2 and 3 respectively. The joint profile 1 comprises a first edge portion 10 and a second edge portion 11. The first edge portion 10 comprises a main body portion 101, a bridge portion 102 being at one end connected to the main body portion 101 said bridge portion 102 further being provided with a distal edge 103 and a connector means 104 arranged close to the distal edge 103. The second edge portion 11 is provided with a second main body portion 111 comprising a connector receiving means 114. The main body portion 101 is provided with an edge portion 105 having a geometry adapted for joining with a selected edge $\mathbf{2}^{I}$, $\mathbf{2}^{II}$, $\mathbf{3}^{I}$ and $\mathbf{3}^{II}$ respectively of the panels 2 and 3 respectively. The second main body portion 111 is provided with an edge member 115 having a geometry adapted for joining with a selected edge $\mathbf{2}^{I}$, $\mathbf{2}^{II}$, $\mathbf{3}^{I}$ and $\mathbf{3}^{II}$ respectively of the panels 2 and 3 respectively.

The edge portion 105 is provided with joining means having a groove provided with undercuts in a lower cheek and an upper cheek allowing snap fitting.

The edge member 115 is provided with joining means having a tongue provided with protrusions allowing snap fitting.

The connector means 104 is provided with a protruding lower end 106. The connector receiving means 114 are provided with a cavity 116 intended for receiving the protruding lower end 106 of the connector means 104. The connector means 104 is flexible, designed as to allow the connector means 104 to flex angularly around a lower pivot point. The connector receiving means 114 is hereby so designed as to allow the connector means 104 to move, thereby allowing the bridge portion 102 to move in a horizontal direction relative the second main body portion 111. A hollow space 107 is formed under the bridge portion 102. The hollow space 107 may be used for arranging cables. The allowed horizontal movement results in a play is suitably the range 1-2 mm.

The portion arranged between the distal edge 103 and an upper portion of the selected edge $\mathbf{2}^{I}$, $\mathbf{2}^{II}$, $\mathbf{3}^{I}$ and $\mathbf{3}^{II}$ respectively of the panels 2 and 3 respectively may suitably be made resilient. This portion can for example be made of rubber or the like.

The panels 2 and 3 most often comprises a core to which an upper decorative layer has been applied. The core often consists of wood particle or fibre bonded together by glue or resin. It might be advantageous to treat the surface closest to the joint in cases where the floor will be exposed to moisture, since the wood in the core is sensitive to moisture. This surface treatment may suitably include resin, wax or some kind of lacquer. It is not necessary to coat the joint if it is to be glued since the glue itself will protect the core from moisture penetration. The decorative upper surface is constituted by a decorative paper impregnated with melamine-formaldehyde resin. One or more layers of so-called overlay papers made of cellulose, impregnated with melamine-formaldehyde resin are possibly placed on top of this. The abrasion resistance can be improved further by sprinkling one or more of the layers with hard particles of for example aluminium oxide, silicon carbide or silicon oxide in connection to the impregnation. The lower side may suitably be coated with lacquer or a layer of paper and resin.

FIG. 2 shows in cross-section a joint profile for panels according to a second embodiment of the present invention. FIG. 2 shows a joint profile 1 intended to be arranged between panels 2 and 3 respectively. The joint profile 1 comprises a first edge portion 10, a second edge portion 11 and a bridge portion 12.

The first edge portion 10 comprises a first main body portion 101 comprising a connector receiving means 114. The first main body portion 101 is provided with an edge portion 105 having a geometry adapted for joining with a selected edge $\mathbf{2}^{I}$, $\mathbf{2}^{II}$, $\mathbf{3}^{I}$ and $\mathbf{3}^{II}$ respectively of the panels 2 and 3 respectively.

The bridge portion 12 is at one end connected to the first main body portion 101 via a first connector means 104 adapted to fit the connector receiving means 114, said bridge portion 102 further being provided with a second end being provided with a second connector means $\mathbf{104}^{I}$ adapted to fit the connector receiving means 114.

The second edge portion 11 is provided with a second main body portion 111 comprising a connector receiving means 114. The second main body portion 111 is provided with an edge member 115 having a geometry adapted for joining with a selected edge $\mathbf{2}^{I}$, $\mathbf{2}^{II}$, $\mathbf{3}^{I}$ and $\mathbf{3}^{II}$ respectively of the panels 2 and 3 respectively.

The edge portion 105 is provided with joining means having a tongue provided with girders or claws allowing a gripping squeeze fitting.

The edge member 115 is provided with joining means having a tongue provided with girders or claws allowing a gripping squeeze fitting.

The first and second connector means 104 and $\mathbf{104}^{I}$ respectively is provided with a protruding lower end 106. The connector receiving means 114 are provided with a cavity 116 intended for receiving the protruding lower end 106 of the connector means 104 and $\mathbf{104}^{I}$ respectively. The first and second connector means $\mathbf{104}^{I}$ is flexible. The connector receiving means 114 is so designed as to allow the first connector means 104 to flex angularly around a lower pivot point. The connector receiving means 114 are so designed as to allow the first and second connector means 104 and $\mathbf{104}^{I}$ respectively to flex angularly around a lower pivot point. The connector receiving means 114 are hereby so designed as to allow the first and second connector means 104 and $\mathbf{104}^{I}$ respectively to move, thereby allowing the bridge portion 102 to move in a horizontal direction relative the first and or second main body portion 101 and 111 respectively. The allowed horizontal movement results in a play is suitably the range 1-5 mm.

A hollow space 107 is formed under the bridge portion 102. The hollow space 107 may be used for arranging cables or other items discussed in the present application.

The invention is not limited by the embodiments shown since they can be varied in different ways within the scope of the invention. The joint profile 1 may for example be made of a multiple of different materials such as a thermosetting or thermoplastic material, with or without filler materials and fibre for reinforcement. It is also possible to make the joint profile 1 of metal such as aluminium and steel. It is also possible to use combinations of materials such as aluminium and thermoplastic or thermo-elastic material. Finally the upper face of the joining profile may be decorated with a decorative material such as a thermosetting laminate, a thermoplastic foil, a solid wood, a metal foil, a lacquer, a transfer print, a natural rubber or a thermo-elastic material.

The invention claimed is:

1. A joint profile (1) for creating a flush transition between two panels each panel having a planar upper surface, said profile intended to be arranged between first and second panels (2 and 3 respectively), the joint profile (1) comprising a first edge portion (10) and a second edge portion (11), wherein the first edge portion (10) comprises a first main body portion (101) and a bridge portion (102) being at one end integral to the first main body portion (101); said first main body portion (101) being configured for removable engagement with the first panel (2), the engagement causing the first main body portion (101) to be coplanar with the upper surface of the first panel (2), said bridge portion (102) further being provided with a distal edge (103) and a connector elements (104) arranged close to the distal edge (103); the second edge portion (11) is provided with a second main body portion (111) being configured for removable engagement with the second panel (3), the engagement causing the second main body portion (111) to be coplanar with the upper surface of said second panel (3), said second main body portion (111) also comprising a connector receiving elements (114), that the first main body portion (101) is provided with an edge portion (105) having a geometry adapted for removable joining with a selected edge ($\mathbf{2}^{I}$, $\mathbf{2}^{II}$, $\mathbf{3}^{I}$, and $\mathbf{3}^{II}$ respectively) of the first panel and that the second main body portion (111) is provided with an edge member (115) having a geometry adapted for removable joining with a selected edge ($\mathbf{2}^{I}$, $\mathbf{2}^{II}$, $\mathbf{3}^{I}$ and $\mathbf{3}^{II}$ respectively) of the second panel (3), such that said connector element (104) can mate with said connector receiving elements (114) so that the panels can expand and contract, and a hollow space (107) is formed under the bridge portion (102).

2. The joint profile (1) according to claim 1, wherein the edge portion (105) is provided with joining elements selected from the group consisting of tongue, groove, undercut, protrusion, girder, web, lower cheek, upper cheek, resilient portion, hook, grapnel, claw and combinations thereof.

3. The joint profile (1) according to claim 1, wherein the edge member (115) is provided with joining elements selected from the group consisting of tongue, groove, undercut, protrusion, girder, web, lower cheek, upper cheek, resilient portion, hook, grapnel, claw and combinations thereof.

4. The joint profile (1) according to claim 1, wherein the connector element (104) is provided with a protruding lower end (106) and that the connector receiving element are provided with a cavity (116) shaped to receive the protruding lower end (106) of the connector element (104).

5. The joint profile (1) according to claim 1, wherein the connector element (104) is flexible.

6. The joint profile (1) according to claim 5, wherein the connector receiving element (114) is shaped as to allow the connector element (104) to flex angularly around a lower pivot point.

7. The point profile (1) according to claim 5, wherein the connector receiving element (114) is shaped as to allow the connector element (104) to move, thereby allowing the bridge portion (102) to move in a horizontal direction relative to the second main body portion (111).

8. The joint profile (1) according to claim 7, wherein the allowed horizontal movement results in a play which is in the range 0.1-5 mm.

9. The joint profile (1) according to claim 1, wherein the hollow space (107) is used for arranging cables.

10. The joint profile (1) according to claim 1, wherein a portion of the second main body portion (111), arranged between the distal edge (103) and an upper portion of the selected edge ($\mathbf{2}^{I}$, $\mathbf{2}^{II}$, $\mathbf{3}^{I}$, and $\mathbf{3}^{II}$ respectively) of the first and second panels (2 and 3 respectively), is made resilient.

11. The joint profile (1) for creating a flush transition between two panels each having a planar surface, said joint profile intended to be arranged between first and second panels (2 and 3 respectively), the joint profile (1) comprising a first edge portion (10), a second edge portion (11) and a bridge portion (12)

wherein the first edge portion (10) comprises a first main body portion (101) comprising a connector receiving element (114), that the first main body portion (101) is provided with an edge portion (105) having a geometry adapted for joining with a selected edge ($\mathbf{2}^{I}$, $\mathbf{2}^{II}$, $\mathbf{3}^{I}$ and $\mathbf{3}^{II}$ respectively) of the first panel (2) and configured in a manner to be coplanar with an upper surface of said first panel (2) where body portion (101) meets the first panel (2);

wherein the bridge portion (12) is at one end connected to the first main body portion (101) via a first connector element (104) adapted to fit the connector receiving element (114), said bridge portion (102) further being provided with a second end being provided with a second connector element ($\mathbf{104}^{I}$) adapted to fit the connector receiving element (114) and, wherein the second edge portion (11) is provided with a second main body portion (111) comprising a connector receiving element (114), and that the second main body portion (111) is provided with an edge member (115) having a geometry adapted for joining with a selected edge ($\mathbf{2}^{I}$, $\mathbf{2}^{II}$, $\mathbf{3}^{I}$ and $\mathbf{3}^{II}$ respectively) of the second panel, and configured in a manner as to be coplanar with an upper surface of said second panel (3) where the second main body portion (111) meets the second panel (3), and a hollow space (107) is formed under the bridge portion (102).

12. The joint profile (1) according to claim 11, wherein the edge portion (105) is provided with joining element selected from the group consisting of tongue, groove, undercut, protrusion, girder, web, lower cheek, upper cheek, resilient portion, hook, grapnel, claw and combinations thereof.

13. The joint profile (1) according to claim 11, wherein the edge member (115) is provided with joining elements selected from the group consisting of tongue, groove, undercut, protrusion, girder, web, lower cheek, upper cheek, resilient portion, hook, grapnel, claw and combinations thereof.

14. The joint profile (1) according to claim 11, wherein the first and second connector elements (104 and $\mathbf{104}^{I}$ respectively) is provided with a protruding lower end (106) and that the connector receiving elements (114) are provided with a cavity (116) shaped to receive the protruding lower end (106) of the connector elements (104 and $\mathbf{104}^{I}$ respectively).

15. The joint profile (1) according to claim 11, wherein the first and second connector elements ($\mathbf{104}^{I}$) are flexible.

16. The joint profile (1) according to claim 15, wherein the connector receiving elements (114) are so designed as to allow the first and second connector element (104 and $\mathbf{104}^{I}$ respectively) to move, thereby allowing the bridge portion (102) to move in a horizontal direction relative the first and second main body portion (101 and 111 respectively).

17. The joint profile (1) according to claim 11, wherein the first connector element (104) is flexible.

18. The joint profile (1) according to claim 11, wherein the connector receiving elements (114) is shaped as to allow the first connector elements (104) to flex angularly around a lower pivot point.

19. The joint profile (1) according to claim 18, wherein the allowed horizontal movement results in a play which is in the range 0.1-10 mm.

20. The joint profile (1) according to claim 11, wherein the connector receiving elements (114) is shaped as to allow the second connector element ($\mathbf{104}^{I}$) to flex angularly around a lower pivot point.

21. The joint profile (1) according to claim 11, wherein a portion of at least one of the first and second main body portions (101) and (111), respectively arranged between the end of the bridge portion (12) and an upper portion of the selected edge ($\mathbf{2}^{I}$, $\mathbf{2}^{II}$, $\mathbf{3}^{I}$ and $\mathbf{3}^{II}$ respectively) of the first and second panels (2 and 3 respectively), is made resilient.

* * * * *